United States Patent [19]

Oba et al.

[11] Patent Number: 4,882,480

[45] Date of Patent: Nov. 21, 1989

[54] APPARATUS FOR DETECTING THE POSITION OF INCIDENCE OF PARTICLE BEAMS INCLUDING A MICROCHANNEL PLATE HAVING A STRIP CONDUCTOR WITH COMBED TEETH

[75] Inventors: Koichiro Oba, Shizuoka, Japan; Wilfried Schoeps, Koblenz; David Taqqu, Zurich, both of Switzerland

[73] Assignee: Hamamatsu Photonics Kabushiki Kaisha, Shizuoka, Japan

[21] Appl. No.: 95,262

[22] Filed: Sep. 11, 1987

[30] Foreign Application Priority Data

Sep. 12, 1986 [JP] Japan ..... 61-215400

[51] Int. Cl.[4] ..... H01J 31/50; H01J 40/14

[52] U.S. Cl. ..... 250/213 VT; 313/103 CM

[58] Field of Search ..... 250/213 VT; 313/103, 313/103 CM, 105, 105 CM

[56] References Cited

U.S. PATENT DOCUMENTS

| | | | |
|---|---|---|---|
| 4,024,390 | 5/1977 | Bosserman et al. | 250/213 VT |
| 4,051,468 | 9/1977 | Rajchman | 313/103 CM |
| 4,086,486 | 4/1978 | Bybee et al. | 313/103 |
| 4,109,178 | 8/1978 | Catanese et al. | 250/213 VT |
| 4,184,069 | 1/1980 | Bosserman | 250/213 VT |
| 4,555,731 | 11/1985 | Zinchuk | 250/213 VT |
| 4,560,898 | 12/1985 | Knapp et al. | 313/105 CM |
| 4,764,139 | 8/1988 | Murata et al. | 313/105 CM |

*Primary Examiner*—David C. Nelms
*Assistant Examiner*—William L. Oen
*Attorney, Agent, or Firm*—Finnegan, Henderson, Farabow, Garrett, and Dunner

[57] ABSTRACT

An apparatus is provided for detecting the one-dimensional position of incidence of particle beams. The apparatus comprises a microchannel plate having a portion that forms a strip conductor for a microstrip line, an electrode on the output surface that is formed of a plurality of stripes that extend from said strip conductor forming portion in the form of spaced comb teeth, and a ground conductor that is associated with said strip conductor;

an operating power source that supplies an operating voltage to each component of said microchannel plate; and an incident position detector circuit that picks up an output signal from both ends of said strip conductor and which estimates, on the basis of the difference between the times at which said output signals were generated, the position of incidence of particle beams that encountered the surface of incidence of said microchannel plate.

12 Claims, 6 Drawing Sheets

APPARATUS FOR DETECTING THE POSITION OF INCIDENCE OF PARTICLE BEAMS INCLUDING A MICROCHANNEL PLATE HAVING A STRIP CONDUCTOR WITH COMBED TEETH

BACKGROUND OF THE INVENTION

The present invention relates to an apparatus capable of high-speed detection of the position of incidence of particle beams such as those of electrons and photons.

Microchannel plates are extensively used to detect and multiply charged particles such as single electrons or photons such as those of UV light, X-rays and gamma-rays. The position at which these particles are incident upon the microchannel plate must be in exact alignment with the position where they emerge from the plate and this alignment is established for each of the channels. To this end, attempts are being made to detect the position of incident particles encountering the microchannel plate by combining it with an appropriate device such as a semiconductor position sensitive device (PSD) using the PN junction of a silicon semiconductor, a "resistive anode" device using a resistor, or a wedge-and-stripe anode using a combination of a stripe electrode and a wedge electrode. In order to facilitate the processing of the output from the microchannel plate in subsequent electronic circuitry, single charged particles, say, electrons, are preferably multiplied by factors of $10^6$–$10^7$ or even more. A method currently employed to meet this need is to perform multiplication at more than one stage through two or more microchannel plates placed in tandem.

FIG. 10 is a diagrammatic cross section of a conventional apparatus for detecting the position of incidence of photons by converting them to photoelectrons. A photocathode 1 is formed on the inner side of the surface of a vacuum chamber 5 where photons are to be encountered. The individual photoelectrons emitted from the photocathode 1 are multiplied as they pass through two microchannel plates 101 and 102. As already mentioned, the factor by which these electrons are multiplied is in the range of $10^6$–$10^7$. The multiplied electrons then encounter a two-dimensional incident position detector 103 that is formed of a PSD located in a face-to-face relationship with the output surface of the microchannel plate 102.

FIG. 11 is a sketch of the two-dimensional incident position detector PSD as seen from the surface of the chamber 5 where photons are to be encountered. The two-dimensional incident position detector 103 has a uniform resistive surface and two electrode pairs X-hd 1-$X_2$ and $Y_1$-$Y_2$ that surround this resistive surface. Each of the electrodes produces an electric current that contains information on the position of incidence of electrons. If the currents flowing out of the electrodes $X_1$, $X_2$, $Y_1$ and $Y_2$ are written as $ix_1$, $ix_2$, $iy_1$and $iy_2$, respectively, the coordinates, x and y, of the point of incidence are given by the following equations, assuming that the coordinates of the center of the area surrounded by the four electrodes are (0, 0):

$$x=k1(ix_1-ix_2)/(ix_1+ix_2)$$

$$y=k2(iy_1-iy_2)/(iy_1+iy_2)$$

where k1 and k2 are constants. These equations are derived on the basis of the assumption that, as shown in FIG. 12, the amount of the current appearing at each terminal is in inverse proportion to the value of resistance offered by the distance from the point of incidence of a particle to that terminal.

The time response characteristics of the abovedescribed apparatus for detecting the position of incidence of particle beams provide an important factor in the determination of the counting rate of single incident signals. The response of the detector is preferably as quick as possible and this is also true for the case where the position signal is to be fed back and used as a control signal. Consider, for example, the case of controlling muon beams. Muons, as they pass through a thin carbon film, will emit secondary electrons. The secondary electrons, which are much smaller in mass than muons, will travel much faster when accelerated. By detecting the position of these electrons at which they encounter a position detector that employs microchannel plates, one is able to identify the position where the muons passed through the carbon film. If the located position is different from the desired position, a signal is fed to deflecting electrodes behind the carbon film (this is a feedback operation) so that the muons will be deflected to the desired position. The operating principle of this control is that secondary electrons which are much lighter than muons are accelerated to travel at such high speeds that the position of their incidence can be rapidly detected by the microchannel plates. In order for the intended control to be performed successfully, the time required for the control including the detection time must be shorter than the reciprocal of the travelling speed of muons.

The PSD type incident position detector which employs the PN junction of a semiconductor has a large capacity and its time constant is as large as several hundred nanoseconds. The resistive anode type detector can be designed to have a capacity that is about one order of magnitude smaller than that of the PSD type but its time constant is only a little smaller than 100 nanoseconds. The wedge-and-stripe type detector has the potential to be operated with a shorter response time than the PSD and resistive anode types, but has the disadvantage of having complex structure. If the structure of a position detector is complex, the calculation of current distribution also becomes complex and hence time-consuming, and this eventually leads to an increased overall response time.

Under the circumstances described above, none of the prior art position reading apparatus that combine conventional types of microchannel plate with other incident position detectors have succeeded in attaining a quick response faster than 10 nanoseconds.

SUMMARY OF THE INVENTION

A principal object, therefore, of the present invention is to provide an apparatus for detecting the position of incidence of particle beams that is capable of high-speed production of one-dimensional information on the position of incidence of particle beams such as electrons and photons by employing a microchannel plate characterized by an improved configuration of electrodes on the output surface.

Another object of the present invention is to provide an apparatus for detecting the position of incidence of particle beams that is capable of high-speed production of two-dimensional information on the position of incidence of particle beams by employing a pair of said improved microchannel plates.

A further object of the present invention is to provide an apparatus for detecting the position of incidence of particle beams that is capable of high-speed production of two-dimensional information on the position of incidence of particle beams by combining said improved microchannel plate with an improved resistive anode type detector (i.e., resistive sheet incident position detector).

The first object of the present invention can be attained by an apparatus for detecting the one-dimensional position of incidence of particle beams that comprises:

a microchannel plate having a portion that forms a strip conductor for a microstrip line, an electrode on the output surface that is formed of a plurality of stripes that extend from said strip conductor forming portion in the form of spaced comb teeth, and a ground conductor that is associated with said strip conductor;

an operating power source that supplies an operating voltage to each component of said microchannel plate; and an incident position detector circuit that picks up an output signal from both ends of said strip conductor and which estimates, on the basis of the difference between the times at which said output signals were generated, the position of incidence of particle beams that encountered the surface of incidence of said microchannel plate.

The position of incidence of electrons in the direction of said strip conductor can be detected by rendering linear the electrode of which the strip conductor in said microchannel plate is formed and by allowing said stripes to extend at right angles to said strip conductor.

The position of incidence of electrons in an angular direction can be detected by employing a configuration in which said microchannel plate is in a disk form, said strip conductor being provided along the circumference of the beam-emerging surface of the plate, and said stripes extending from said strip conductor toward the center of the microchannel plate.

The position of incidence of electrons in the radial direction can be detected by employing a configuration in which said microchannel plate is in a disk form, said strip conductor being provided in the radial direction of the beam-emerging surface of the microchannel plate, and said stripes extending concentrically from said strip conductor.

The second object of the present invention can be attained by an apparatus for detecting the position of incidence of particle beams that comprises:

a first microchannel plate having a portion that forms a strip conductor for a microstrip line, an electrode on the output surface that is formed of a plurality of stripes that extend from said strip conductor forming portion in the form of spaced comb teeth, and a ground conductor that is associated with said strip conductor;

a second microchannel plate having a portion that forms a strip conductor for a microstrip line in a plane that is parallel to the output surface of said first microchannel plate, an electrode on the output surface that is formed of a plurality of stripes that extend from said strip conductor forming portion in the form of spaced comb teeth, and a ground conductor that is associated with said strip conductor and which is provided at substantially right angles with respect to the corresponding portion of said first microchannel plate;

a power source that supplies an operating voltage to each component of said microchannel plate and which also supplies said second microchannel plate with a voltage for receiving the electrons emitted from said first microchannel plate; and a microchannel plate incident position detector circuit that picks up an output signal from both ends of each of said strip conductors and which estimates, on the basis of the difference between the times at which said output signals were generated, the position of incidence of particle beams that encountered the surface of incidence of each of said microchannel plates.

The third object of the present invention can be attained by an apparatus for detecting two-dimensional position of incidence of particle beams that comprises:

a microchannel plate having a portion that forms a strip conductor for a microstrip line, an electrode on the output surface that is formed of a plurality of stripes that extend from said strip conductor forming portion in the form of spaced comb teeth, and a ground conductor that is associated with said strip conductor;

an anode plate having a plurality of resistive wires in stripes that extend in the form of comb teeth in a plane parallel to the output surface of said microchannel plate and in a direction normal to the stripes in said microplate channel, and a strip conductor that forms a strip line to which said resistive wires are connected;

a power source that supplies an operating voltage to each component of said microchannel plate and which also supplies said anode plate with a voltage for receiving the electrons emitted from said microchannel plate;

a microchannel plate incident position detector circuit that picks up an output signal from both ends of each of said strip conductors and which estimates, on the basis of the difference between the times at which said output signals were generated, the position of incidence of particle beams that encountered the surface of incidence of said microchannel plate; and an anode plate incident position detector which estimates, on the basis of the output current from the resistive wires in said anode plate, the position of incidence of electrons in a different direction than is attained with said microchannel plate.

Figure 1:
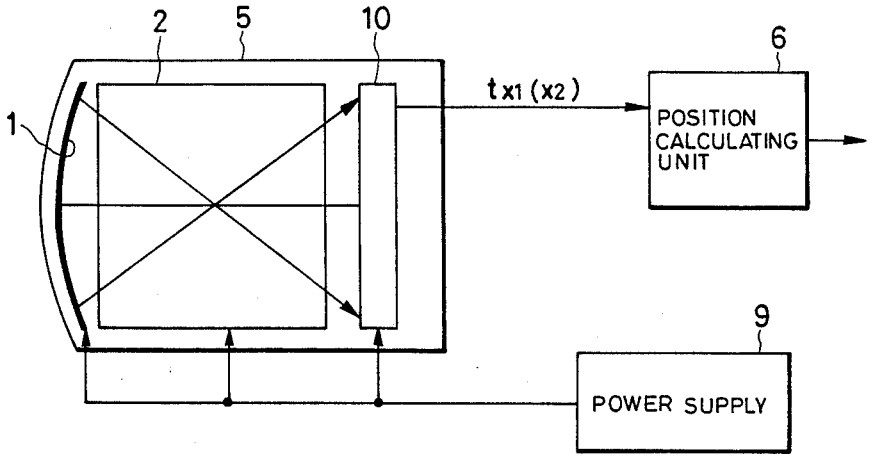
FIG. 1 is a block diagram of an apparatus for detecting the position of incidence of particle beams according to one embodiment of the present invention.
Figure 2:
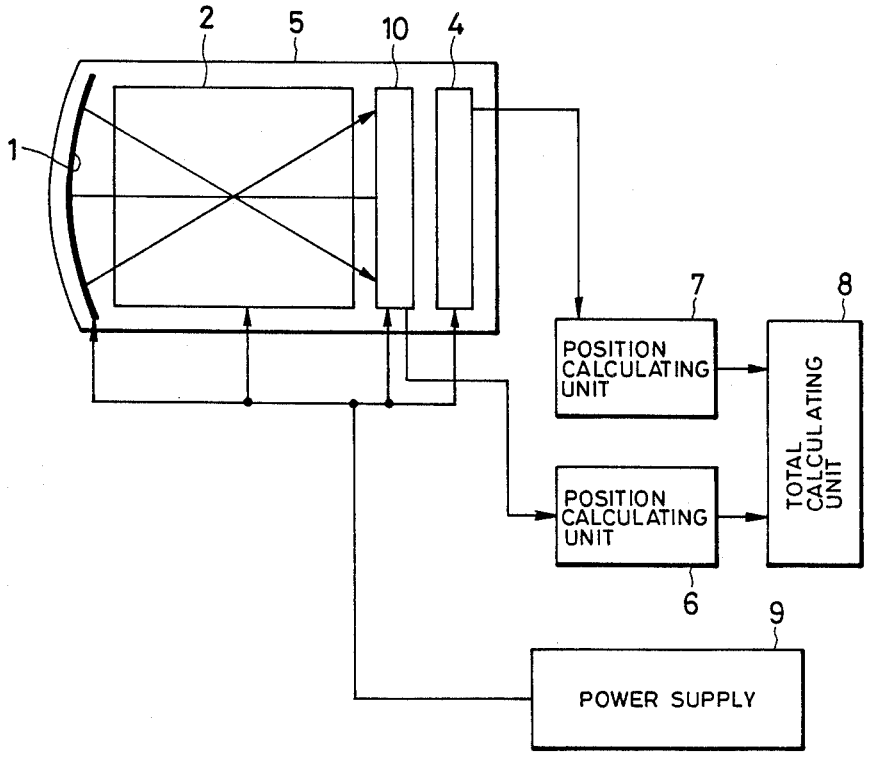
FIG. 2 is a block diagram of an apparatus according to another embodiment of the present invention which is capable of achieving two-dimensional detection of the position of incidence of particle beams by combining, the system shown in FIG. 1 with another one-dimensional position detector.
Figure 3I:
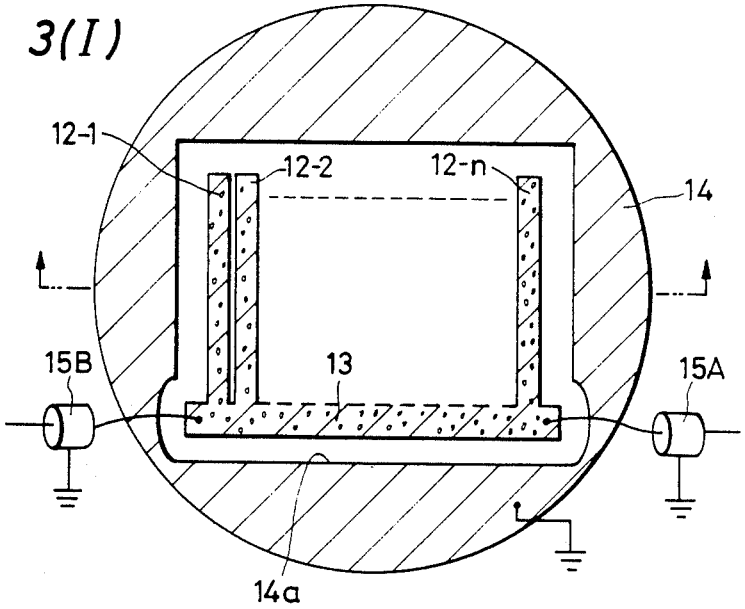
FIG. 3(I) shows the beam-emerging surface of a first type (linear type) of microchannel plate to be used in the incident position detector of the present invention.
Figure 3:
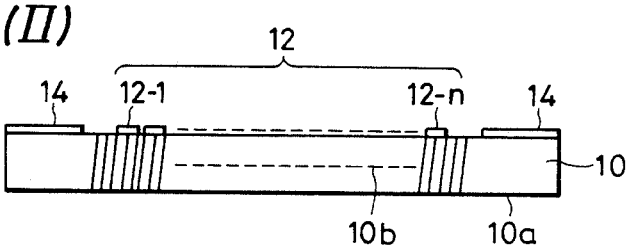
Figure 4:
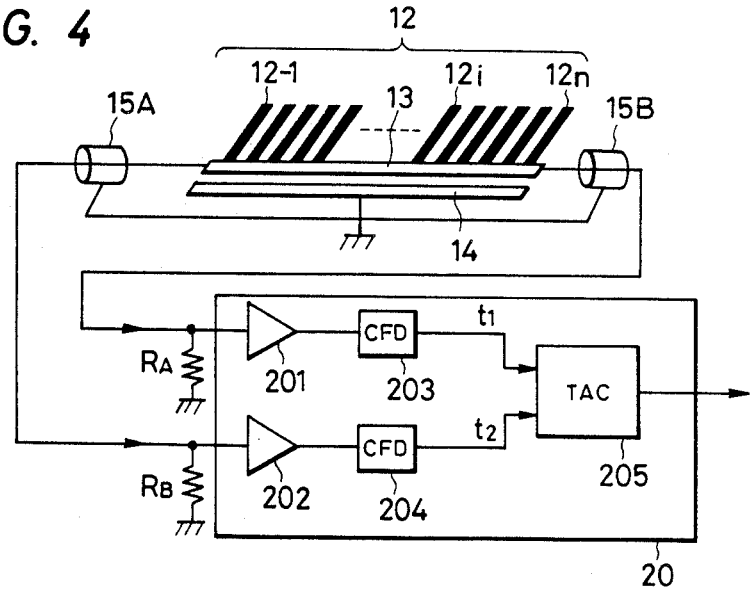
Figure 5:
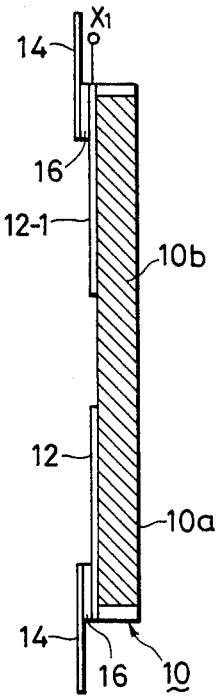
Figure 5I:
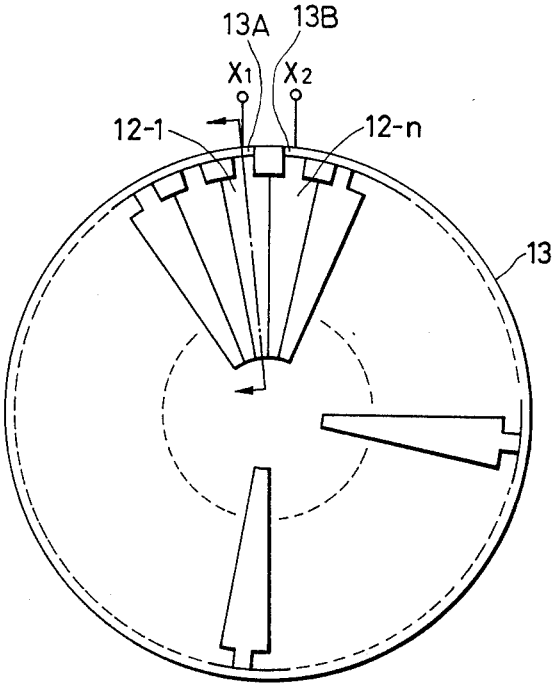
Figure 6I:
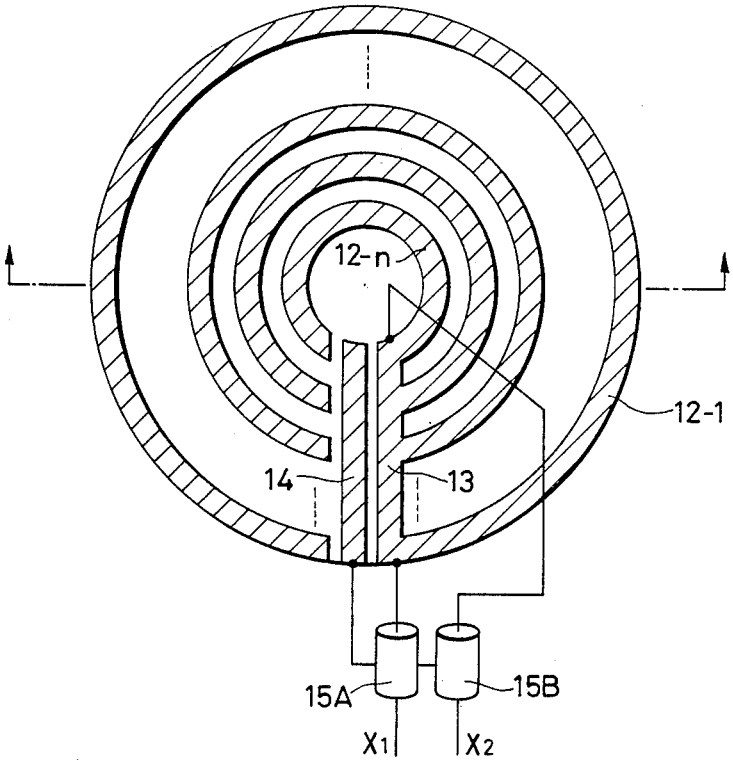
Figure 6:
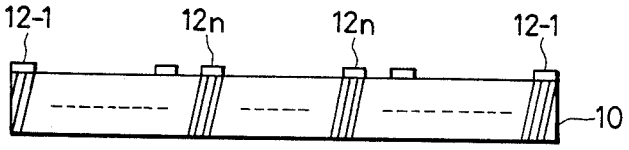
Figure 7:
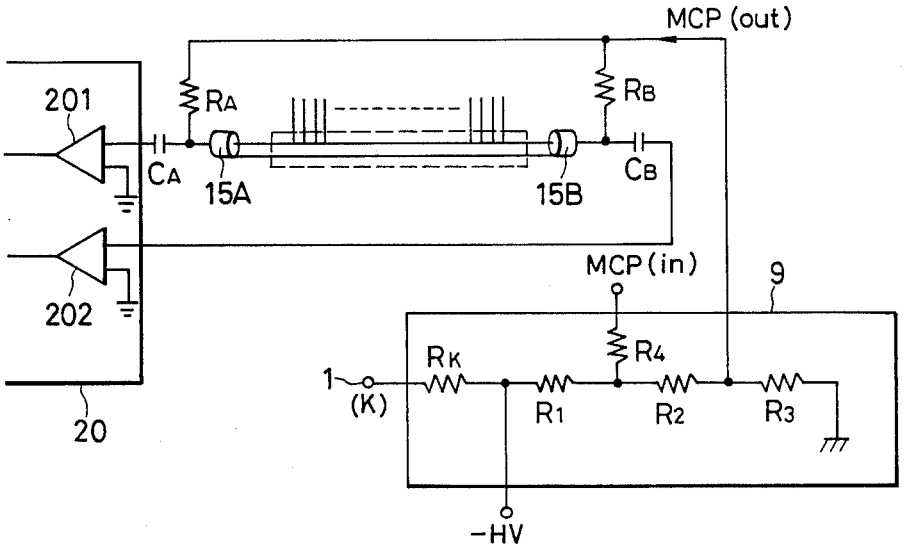
Figure 8:
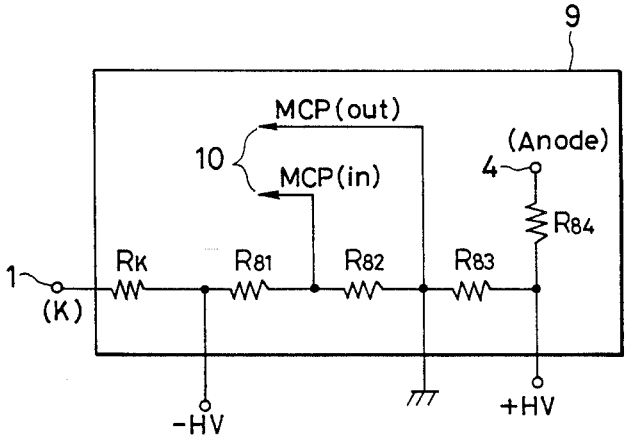
Figure 9:
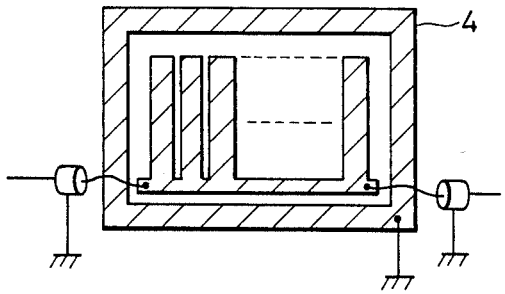
Figure 10:
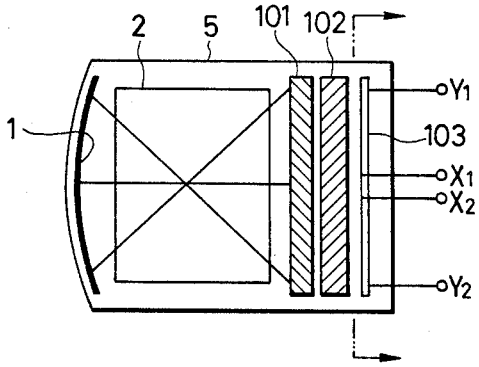
Figure 11:
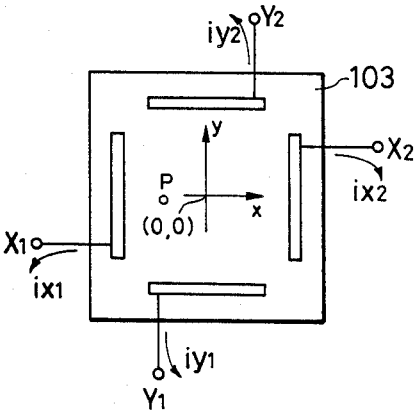
Figure 12:
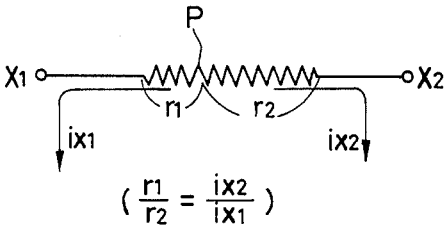

The microchannel plate shown in FIG. 3(II) is a sectional view of FIG. 3(I);

FIG. 4 shows an equivalent circuit of the microchannel plate shown in FIG. 3 and a circuit diagram of an illustrative position calculating unit;

FIG. 5(I) shows the beam-emerging surface of a second type (0 type) of microchannel plate to be used in the incident position detector of the present invention;

The microchannel plate shown in FIG. 5(II) is a sectional view of FIG. 5(I);

FIG. 6(I) shows the beam-emerging surface of a third type (r type) of microchannel plate to be used in the incident position detector of the present invention;

The microchannel plate shown in FIG. 6(II) is a sectional view of FIG. 6(I);

FIG. 7 is a circuit diagram of an illustrative power supply unit that may be used with the incident position detector shown in FIG. 1;

FIG. 8 is a circuit diagram of an illustrative power supply unit that may be used with the incident position detector shown in FIG. 2;

FIG. 9 is a diagram showing an illustrative pattern of the layout of resistive wires on a resistive anode type detector (i.e., resistive sheet incident position detector);

FIG. 10 is a diagrammatic cross section of a prior art incident position detector that measures the position of incidence of photons by converting them to photoelectrons;

FIG. 11 shows a two-dimensional incident position detector as seen from the surface to be encountered by incident photons; and FIG. 12 is an equivalent circuit diagram showing the characteristics of the two-dimensional incident position detector in its x-direction.

DESCRIPTION OF THE PREFERRED EMBODIMENTS

The present invention is hereinafter described in detail with reference to the accompanying drawings.

FIG. 1 is a sketch of an apparatus for detecting the position of incidence of particle beams according to one embodiment of the present invention. The apparatus shown in this figure measures the position of incidence of photons by converting them to photoelectrons. When photons encounter a photocathode 1 in a vacuum chamber 5, photoelectrons are emitted from the cathode 1. The emitted photoelectrons are focused by a well-known electronic lens unit to encounter the surface of incidence of a microchannel plate 10. In the apparatus shown in FIG. 1, the microchannel plate 10 is so designed that it is capable of producing by itself information on the position of incidence of the photoelectrons that encountered the plate. A signal from the output electrode of the microchannel plate 10 is fed into an incident position calculating unit 6 which then produces a signal indicating the position of incidence. A power supply unit 9 in FIG. 1 supplies an operating voltage to the electrodes in the vacuum chamber 5.

FIG. 3 shows a first type of microchannel plate to be used in the incident position detector of the present invention depicted in FIG. 1. FIG. 3(I) shows the beam-emerging surface of the plate, and FIG. 3(II) is a sectional view of the microchannel plate shown in FIG. 3(I). The microchannel plate includes fine channel multipliers that are placed side by side to provide a structure adapted for intensification of the images of electrons. The channel multipliers have inside diameters of 10 to 20 μm and are fused together in a honeycomb configuration.

If electrons are permitted to encounter the negative side of the microchannel plate, with a voltage applied across the plate, they will appear at the positive electrode side after being multiplied by a factor of $10^3$–$10^5$. The electrons may be further accelerated by a subsequent accelerating electric field. The channel multipliers are in most cases inclined with respect to the surface of incidence so as to increase the factor of multiplication of electrons that encounter that surface in a normal direction. Therefore, as shown in FIG. 3(II), a large number of channels 10*b* having surface characteristics for emission of secondary electrons are provided in an inclined manner in the interior of the microchannel plate 10.

Reference numeral 14 designates a ground conductor. A strip conductor 13 and stripes 12-l to 12-n form an electrode on the output side of the microchannel plate. The strip conductor 13, ground conductor 14 and stripes 12-l to 12-n are provided with holes that correspond to the individual channels 10*b*. As shown in FIG. 3(I), the strip conductor 13 is linear and connected to the base of each of the stripes 12-l to 12-n which are arranged in a comb-shaped pattern. The portion 14*a* of the ground conductor 14 combines with the strip conductor 13 to form a microstrip line. One end of the strip conductor 13 is connected to the central conductor of a coaxial output cable 15A, and the other end of the strip conductor 13 is connected to the central conductor of a coaxial output cable 15B. The outer conductor of each coaxial output cable is connected to the ground conductor 14 of the microchannel plate.

When the electrons encountering the surface of incidence 10*a* of the microchannel plate 10 travel through the channel plate and reach a certain stripe 12-i after being multiplied by a certain factor, electric charges in an amount that corresponds to the multiplied electrons will be supplied to the stripe 12-i through the strip conductor 13. The resulting electrical signal propagates through the stripe 12-i to reach the transmission line of the strip conductor 13 and further travels along this line in opposite directions. The time required for the signal to reach the right or left terminal of the transmission line is proportional to the distance from the stripe 12-i to the particular terminal.

FIG. 4 shows an equivalent circuit of the microchannel plate shown in FIG. 3 and a circuit diagram of an illustrative position calculating unit. The coaxial output cables 15A and 15B are connected to load resistors $R_B$ and $R_A$, respectively, and the voltages produced by the signal currents from the two output lines are respectively amplified by high-speed amplifiers 202 and 201. The outputs from the amplifiers 201 and 202 are respectively connected to constant fraction discriminators 203 and 204 (hereinafter referred to as CFD 203 and 204), which generate a pulse when the received signal is found to be due to the multiplication of electrons.

Suppose here that CFD 203 and 204 generate pulses at times $t_1$ and $t_2$, respectively. Each of the outputs from CFD 203 and 204 is connected to a time-to-amplitude converter 205 which converts said output to a voltage corresponding to the difference between $t_1$ and $t_2$. The time $t_1$ which is defined by the interval between the time when a signal is generated on the microstrip line as a result of multiplication of photoelectrons and the time when CFD 203 generates a detection pulse is the sum of the time required for the signal to travel from the stripe 12-i (in which the channel that received electrons is located) to the right end of the strip conductor 13 and the time required for that signal to reach CFD 203 via coaxial output cable 15A (the latter time may be more exactly defined as the time to pulse generation). In a similar way, the time $t_2$ to the generation of a detection pulse by CFD 204 is the sum of the time required for the signal to travel from the stripe 12-i to the left end of the strip conductor 13 and the time required for that signal to reach CFD 204 via coaxial output cable 15B. Therefore, the difference between $t_1$ and $t_2$ should be proportional to the difference between the distance from the stripe 12-i to the left end of the strip conductor 13 and the distance from the stripe 12-i to the right end of the strip conductor 13. If the signal is incident at a position that corresponds to the central stripe connected to the strip conductor 13, $t_1$ is equal to $t_2$ and the time-to-amplitude converter 205 will produce zero outputs. As the position of incidence of the signal deviates from the center of the strip conductor 13, the converter 205 will produce an increasing output. Therefore, the abscissa of the position of signal incidence can be calculated from the output of the converter 205, assuming that the strip conductor 13 runs in the x-direction and that the abscissa of the center of the conductor 13 is 0.

FIG. 7 is a circuit diagram of an illustrative power supply unit that may be used with the incident position detector shown in FIG. 1. The output electrode of the microchannel plate 10 is connected to the ground via resistors and the input surface of the channel is supplied with a lower voltage than the output electrode. The photocathode 1 is supplied with the lowest potential (−Hv). The signals from the microchannel plate are connected to an incident position detector circuit 20 via capacitors $C_A$ and $C_B$.

FIG. 5 shows a second type of the microchannel plate to be used in the incident position detector of the present invention. FIG. 5(I) is a view of the plate as seen from its beam-emerging surface, with an insulator plate 16 and a ground conductor 14 that also serves as a mounting metal fixture being taken away. FIG. 5(II) is a sectional view of the microchannel plate shown in FIG. 5(I). The microchannel plate 10 is generally in a disk form and the electrode on its beam-emerging surface includes a strip conductor 13 and a plurality of stripes 12-l to 12-n in the form of sectors that extend from the strip conductor 13 inward (i.e., toward the center of the disk). Part of the strip conductor 13 is cut away and the two ends 13A and 13B are respectively connected to the central conductors, $X_1$ and $X_2$, of two coaxial output cables. As shown in FIG. 5(II), an insulator plate 16 is placed over the strip conductor 13 and the ground conductor 14 is placed over the insulator plate 16 to provide an area that serves as a transmission path in the form of a strip line. The signals picked up from both ends of the transmission path are processed with a position calculating circuit 20 (see FIG. 4) to determine the position of incidence of particle beams in an angular direction.

FIG. 6 shows a third type of the microchannel plate to be used in the incident position detector of the present invention. FIG. 6(I) is a view of the plate as seen from its beam-emerging surface and the microchannel plate shown in FIG. 6(II) is a sectional view of FIG. 6(I). The microchannel plate 10 is generally in a disk form and the electrode on its beam-emerging surface includes a strip conductor 13, stripes 12-l to 12-n, and a ground conductor 14. The strip conductor 13 is formed in the radial direction of the disk and extends over a length generally equal to the radius of the disk. The ground conductor 14 is formed parallel to the strip conductor 13. The stripes 12-l to 12-n extend concentrically from the strip conductor 13. The outward terminal of the strip conductor 13 is connected to the central conductor of a coaxial output cable 15A, and the inward terminal of the strip conductor 13 is connected to the central conductor of a coaxial output cable 15B. The ground conductor 14 is connected to the outer conductor of each of the coaxial output cables. The signals picked up from both ends of a transmission path in the form of a strip line are processed with a position calculating circuit 20 (see FIG. 4) to determine the position of incidence of particle beams in the radial direction of the microchannel plate.

The systems shown in FIGS. 3, 5 and 6 are adapted to determine the position of incidence of particle beams in the linear, angular or radial direction, respectively, and are not designed to measure the position of a point in a rectangular or polar coordinate system.

FIG. 2 is a block diagram of an apparatus according to another embodiment of the present invention which is capable of achieving two-dimensional detection of the position of incidence of particle beams by combining the system shown in FIG. 1 with another one-dimensional position detector. A photocathode 1 is a provided on the inside surface of a vacuum chamber 5. The photocathode 1 emits photoelectrons which are guided by an electronic lens unit 2 to encounter the surface of incidence of a microchannel plate 10. The electrons multiplied by passage through the microchannel plate 10 are permitted to encounter a resistive sheet incident position detector 4 in front of the plate 10. The detector 4 will detect the position of incidence of photoelectrons in a direction orthogonal to the direction detected by the microchannel plate 10.

FIG. 8 is a circuit diagram of an illustrative power supply unit that may be used with the incident position detector shown in FIG. 2. The resistive sheet incident position detector 4 is supplied with a higher voltage than the output electrode on the microchannel plate 10. The microchannel plate 10 may be of any of the types that are described with reference to FIGS. 3, 5 and 6 but the incident position detector 4 must be configured so that it matches a certain selected type of microchannel plate 10. For instance, if the microchannel plate 10 of the type shown in FIG. 3 is used to obtain information on the position of beam incidence in the x-direction, the resistive sheet incident position detector 4 must be configured in such a way that it receives from the microchannel plate an output that indicates the position of incidence in the y-direction.

FIG. 9 is a diagram showing an illustrative pattern of the layout of resistive wires on the detector 4 which is shown as a resistive sheet incident position detector capable of producing information on the position of beam incidence in a linear direction.

Another type of the detector capable of achieving two-dimensional detection of the position of incidence of particle beams may be constructed by replacing the resistive sheet incident position detector 4 with a second microchannel plate that has a configuration either the same as or complementary to the first microchannel plate 10.

As described in detail on the foregoing pages, the apparatus of the present invention for detecting the position of incidence or particle beams includes a microchannel plate, an operating power source that supplies an operating voltage to each component of said microchannel plate, and an incident position detector circuit, the microchannel plate having a portion that forms a strip conductor for a microstrip line, an electrode on the output surface that is formed of a plurality of stripes that extend from said strip conductor forming portion in the form of spaced comb teeth, and a ground conductor that is associated with said strip conductor, and the incident position detector circuit that picks up an output signal from both ends of said strip conductor and which estimates, on the basis of the difference between the times at which said output signals were generated, the position of incidence of particle beams that encountered the surface of incidence of said microchannel plate.

According to the present invention, the position of incidence of a single input signal is detected by performing time measurements on the signal passing through a transmission line in the form of a strip line. This eliminates the need to use a resistor and, hence, the problem of delay that is associated with a "CR time constant". Since the only factor that generally needs to be considered is the propagation speed of a distributed constant circuit that preferably is solely composed of an inductance and a capacitance, the system of the present invention can achieve a very quick response on the order of several nanoseconds. As for the detection of time differences, several techniques have already been established and they provide resolutions that are approximate to 10 picoseconds. By making use of these techniques, the system of the present invention is capable of achieving a position resolution better than 1/100. This operational speed can be used not only to improve the counting rate but also to perform control by high-speed feedback of signals.

According to another embodiment of the present invention, a pair of the improved microchannel plates described herein may be combined together to construct a detector system that enables high-speed production of two-dimensional information on the position of incidence of particle beams.

The same result can be attained according to still another embodiment of the present invention in which the improved microchannel plate is combined with an also improved resistive anode type detector circuit.

Additional advantages and modifications will readily occur to those skilled in the art. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

What is claimed is:

1. An apparatus for detecting the position of incidence of a particle beam, said apparatus comprising:

a microchannel plate including an output electrode and a ground electrode, said output electrode including a strip conductor having first and second ends and a plurality of stripes extending from said strip conductor, a portion of said ground conductor being adjacent to and spaced from a portion of said strip conductor so that said ground conductor portion and said strip conductor portion form a microstrip line, the incidence of the particle beam on said output electrode generating a signal, a first portion of the signal being communicated to said first end of said strip conductor and a second portion of the signal being communicated to said second end of said strip conductor; and an incident position detector circuit operatively coupled to said first and second ends of said strip conductor for comparing the arrival time of the first signal portion to the arrival time of the second signal portion to determine the position of incidence of the particle beam on said output electrode.

2. An apparatus according to claim 1 wherein the strip conductor comprises a linear electrode, said stripes comprise mutually parallel spaced comb teeth coupled to said strip conductor, and said ground conductor portion is parallel to said strip conductor portion.

3. An apparatus according to claim 1 wherein said microchannel plate is substantially circular, said strip conductor is substantially circular, and said stripes are coupled to and project radially inward from said strip conductor.

4. An apparatus according to claim 1 wherein said microchannel plate is substantially circular, said strip conductor extends substantially radially within said microchannel plate, and each of said stripes is substantially circular and is coupled to said strip conductor, said stripes being concentric and being spaced from one another.

5. An apparatus for detecting the position of incidence of particle beams, said apparatus comprising:

a first microchannel plate positioned along and perpendicular to an axis and including a first output electrode and a first ground electrode, said first output electrode extending in a first direction perpendicular to the axis and including a first strip conductor having first and second ends and a first plurality of stripes extending from said first strip conductor, a portion of said first ground electrode being adjacent to and spaced from a portion of said first strip conductor so that said first ground electrode portion and said first strip conductor portion form a microstrip line, the incidence of the particle beam on said first output eletrode generating a first signal, a first portion of the first signal being communicated to said first end of said first strip conductor and a second portion of the first signal being communicated to said second end of said first strip conductor;

a second microchannel plate positioned adjacent to and parallel to said first microchannel plate along the axis and including a second output electrode and a second ground electrode, said second output electrode extending in a second direction perpendicular to the first direction and to the axis and including a second strip conductor having first and second ends and a second plurality of stripes extending from said second strip conductor, a portion of said second ground electrode being adjacent to and spaced from a portion of said second strip conductor so that said second ground electrode portion and said second strip conductor portion form a microstrip line, the incidence of a particle beam on said second output electrode generating a second signal, a first portion of the second signal being communicated to said first end of said second strip conductor and a second portion of the second signal being communicated to said second end of said second strip conductor; and a microchannel plate incident position detector circuit operatively coupled to said first and said second ends of said first and second strip conductors for comparing the arrival time of the first portion of the first signal to the arrival time of the second portion of the first signal to determine the position of incidence of the particle beam on said first output electrode in the first direction, and for comparing the arrival time of the second portion of the second signal to the arrival time of the second portion of the second signal to determine the position of incidence of the particle beam on said second output electrode in the second direction.

6. An apparatus for detecting the position of incidence of particle beams, said apparatus comprising:

a microchannel plate positioned along and perpendicular to an axis and including an output electrode and a ground electrode, said output electrode including a first strip conductor having first and second ends and a first plurality of stripes extending from said first strip conductor in a first direction and lying in a first plane perpendicular to the axis, a portion of said ground conductor being adjacent to and spaced from a portion of said first strip conductor so that said ground conductor portion and said first strip conductor portion form a microstrip line, the incidence of the particle beam on said output electrode generating a first signal, a first portion of the first signal being communicated to said first end of said first strip conductor and a second portion of the first signal being communicated to said second end of said first strip conductor;

an anode plate positioned adjacent to and parallel to said microchannel plate along the axis and having a second strip conductor and a second plurality of resistive wire stripes extending from said second strip conductor in a second direction perpendicular to the first direction and lying in a second plane parallel to the first plane;

a microchannel plate incident position detector circuit operatively coupled to said first and said second ends of said first strip conductor for comparing the arrival time of the first portion of the first signal to the arrival time of the second portion of the first signal to determine the position of incidence of the particle beam on said first output electrode in the first direction; and an anode plate incident position detector operatively coupled to said anode plate for sensing an output current from said resistive wire stripes and for determining from the current the position of incidence of the particle beam in the second direction.

7. An apparatus according to claim 5 wherein at least one of the first and second strip conductors comprises a linear electrode, at least one of the first and second plurality of stripes corresponding to the at least one of the first and second strip conductors comprises mutually parallel spaced comb teeth coupled to the corresponding at least one of the first and second strip conductors.

8. An apparatus according to claim 5 wherein at least one of the first and second microchannel plates is substantially circular, at least one of said first and second strip conductors corresponding to the at least one of the first and second microchannel plates is substantially circular, and at least one of the first and second plurality of stripes corresponding to the at least one of the first and second strip conductors are coupled to and project radially inward from the corresponding at least one of the first and second strip conductors.

9. An apparatus according to claim 5 wherein at least one of the first and second microchannel plates is substantially circular, at least one of the first and second strip conductors corresponding to the at least one of the first and second microchannel plates extends substantially radially within the microchannel plate, and each of the stripes of at least one of the first and second plurality of stripes corresponding to the at least one of the first and second strip conductors is substantially circular and is coupled to the corresponding at least one of the first and second strip conductors, the stripes of the at least one of the first and second plurality of stripes being concentric and being spaced from one another.

10. An apparatus according to claim 6 wherein the first strip conductor comprises a linear electrode, said first plurality of stripes comprises mutually parallel spaced comb teeth coupled to said first strip conductor, and said ground conductor portion is parallel to said first strip conductor portion.

11. An apparatus according to claim 6 wherein said microchannel plate is substantially circular, said first strip conductor is substantially circular, and said stripes of the first plurality of stripes are coupled to and project radially inward from said first strip conductor.

12. An apparatus according to claim 6 wherein said microchannel plate is substantially circular, said first strip conductor extends substantially radially within said microchannel plate, and each of said stripes of said first plurality of stripes is substantially circular and is coupled to said first strip conductor, said stripes of said first plurality of stripes being concentric and being spaced from one another.

* * * * *